US007714689B1

(12) United States Patent
Hsieh

(10) Patent No.: US 7,714,689 B1
(45) Date of Patent: May 11, 2010

(54) TRANSFORMER STRUCTURE

(75) Inventor: Wen Sen Hsieh, Taoyuan Hsien (TW)

(73) Assignee: FSP Technology, Inc., Taoyuan Hsien (TW)

( * ) Notice: Subject to any disclaimer, the term of this patent is extended or adjusted under 35 U.S.C. 154(b) by 0 days.

(21) Appl. No.: 12/330,161

(22) Filed: Dec. 8, 2008

(51) Int. Cl.
*H01F 27/30* (2006.01)

(52) U.S. Cl. ..... 336/208; 336/198; 336/192

(58) Field of Classification Search ..... 336/208, 336/198, 192
See application file for complete search history.

(56) References Cited

U.S. PATENT DOCUMENTS

| | | | | |
|---|---|---|---|---|
| 7,183,889 | B2 * | 2/2007 | Fushimi | 336/208 |
| 2005/0073385 | A1 * | 4/2005 | Wu et al. | 336/208 |
| 2007/0216511 | A1 * | 9/2007 | Tseng et al. | 336/208 |
| 2007/0262843 | A1 * | 11/2007 | Chan et al. | 336/198 |
| 2007/0285203 | A1 * | 12/2007 | Ger et al. | 336/208 |
| 2009/0153280 | A1 * | 6/2009 | Chen et al. | 336/192 |

FOREIGN PATENT DOCUMENTS

| | | |
|---|---|---|
| TW | M314404 | 6/2007 |
| TW | M334349 | 6/2008 |

* cited by examiner

*Primary Examiner*—Anh T Mai
(74) *Attorney, Agent, or Firm*—Muncy, Geissler, Olds & Lowe, PLLC

(57) ABSTRACT

A transformer structure includes an iron core set, a main bobbin, and two sub-bobbins. The main bobbin includes a primary winding area for winding a first coil, a main bobbin through hole longitudinally mounted in and penetrating through the main bobbin, and two assembling troughs respectively formed at two ends of the main bobbin through hole. The two sub-bobbins are respectively accommodated in the two assembling troughs and respectively include a secondary winding area for winding a second coil and a sub-bobbin through hole communicated with the main bobbin through hole for penetrating the iron core set. Therefore, the sub-bobbins are mounted in two extended assembling troughs of the main bobbin, the first coil is wound on the primary winding area at the outer side of the main bobbin, and the first coil is separated from the second coils not only by horizontal distance but also by the assembling troughs.

5 Claims, 7 Drawing Sheets

TRANSFORMER STRUCTURE

FIELD OF THE INVENTION

The present invention is related to a transformer structure, and more particularly to a bobbin structure of the transformer which can be wound by at least two sets of coils at the primary side and the secondary side.

BACKGROUND OF THE INVENTION

Various types of transformers are developed for adapting different functional demands, so that when designing transformer, it should consider many properties, such as, transformer ratio, current and loss, and dimension, for example, as the output power and the properties of the transformer are qualified, naturally, the smaller the size, the more different kinds of electric equipment the transformer can be adapted thereto. However, as the transformer works, a large amount of current will be generated and the voltage will have an apparent variation, so that the transformer should conform to severe safety regulation before using. And, for conforming to the safety regulation, on one hand, the transformer is always enlarged for providing sufficient insulation distance for the coils, and thus, obviously, under the same electric characteristic, the miniaturization of the transformer is restricted by the safety regulation. On the other hand, for conforming to safety regulation, most power supply select isolation transformer, such as, TWP No. M314404, entitled "Driving device with isolation transformer used in LCD back light source" which is composed of a DC power supply, a square wave switcher, an isolation transformer and a driver transformer. In this patent, the primary side of the isolation transformer is fluctuated by input power, and for controlling the output power, the power at the primary side of the isolation transformer is constantly changed. And, the secondary side which is not connected with the primary side transmits power only through electromagnetic induction for maintaining the stability and quality of the power which is received by the load. Further, the isolation transformer is used to separate the different voltage potentials of the power input terminal and the load terminal so as to ensure the safety thereof. Another example is TWP No. M334349, entitled "Light tube driving device", in which the light tube driving device includes an inverter, a first transformer, a second transformer, at least one light tube, a control unit and a third transformer. In this patent, FIG. 2 disclosed that two transformers (32, 34) are utilized to transmit energy between the high voltage inverter (30) and the light tube (36) and also to isolate the power fluctuation at the primary and the secondary sides. However, the use of two transformers increases the cost and also the volume.

Consequently, the size and the adaptability of the transformer are restricted by the insulation strength and the power waveform at the primary and the secondary sides.

SUMMARY OF THE INVENTION

Since the conventional transformer is limited by the safety regulation and the power output property, one way to improve the power insulation strength is to alter the bobbin design of the transformer for providing better adaptability to all kinds of circuits and simultaneously conforming to the safety regulation.

The present invention provides a transformer structure including an iron core set, a main bobbin, and two sub-bobbins. The main bobbin includes a primary winding area for winding a first coil, a main bobbin through hole longitudinally mounted in and penetrating through the main bobbin, and two assembling troughs respectively formed at two ends of the main bobbin through hole. The two sub-bobbins are respectively accommodated in the two assembling troughs and respectively include a secondary winding area for winding a second coil and a sub-bobbin through hole communicated with the main bobbin through hole for penetrating the iron core set. Therefore, the sub-bobbins are mounted in two extended assembling troughs of the main bobbin, the first coil is wound on the primary winding area at the outer side of the main bobbin, and the first coil is separated from the second coil not only by horizontal distance but also by the assembling troughs of the main bobbin, so as to provide enhanced insulation strength. Moreover, since the two sub-bobbins can be respectively wound by two independent second coils, the input and the output of the transformer of the present invention can be implemented as the one-to-two type transformer, so as to improve adaptability. Furthermore, since the main bobbin and the sub-bobbins provide sufficient insulation strength, the whole dimension of the transformer can be reduced under the safety regulation, and simultaneously, the output and input isolation also can be guaranteed for preventing the output power from being influenced, thereby increasing the adaptability to different circuits, especially the circuit used in driving discharging lamp, such as, back light module. Therefore, the transformer structure of the present invention provides enhanced insulation strength for conforming the safety regulations.

BRIEF DESCRIPTION OF THE DRAWINGS

The foregoing aspects and many of the attendant advantages of this invention will be more readily appreciated as the same becomes better understood by reference to the following detailed description, when taken in conjunction with the accompanying drawings, wherein.

DESCRIPTION OF THE PREFERRED EMBODIMENT

Figure 1A:
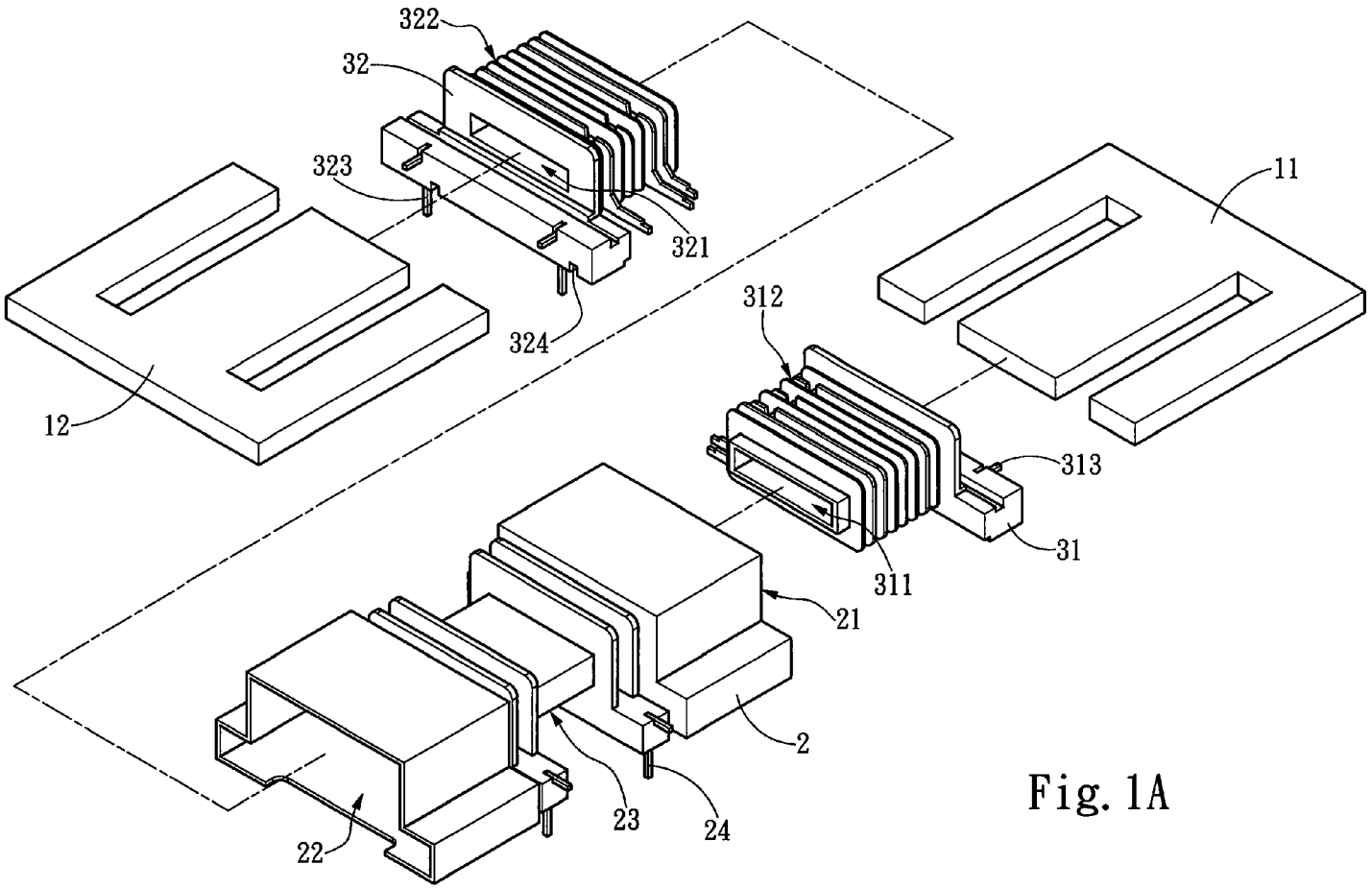
FIG. 1A is a decomposition drawing showing the transformer of the present invention.
Figure 1B:
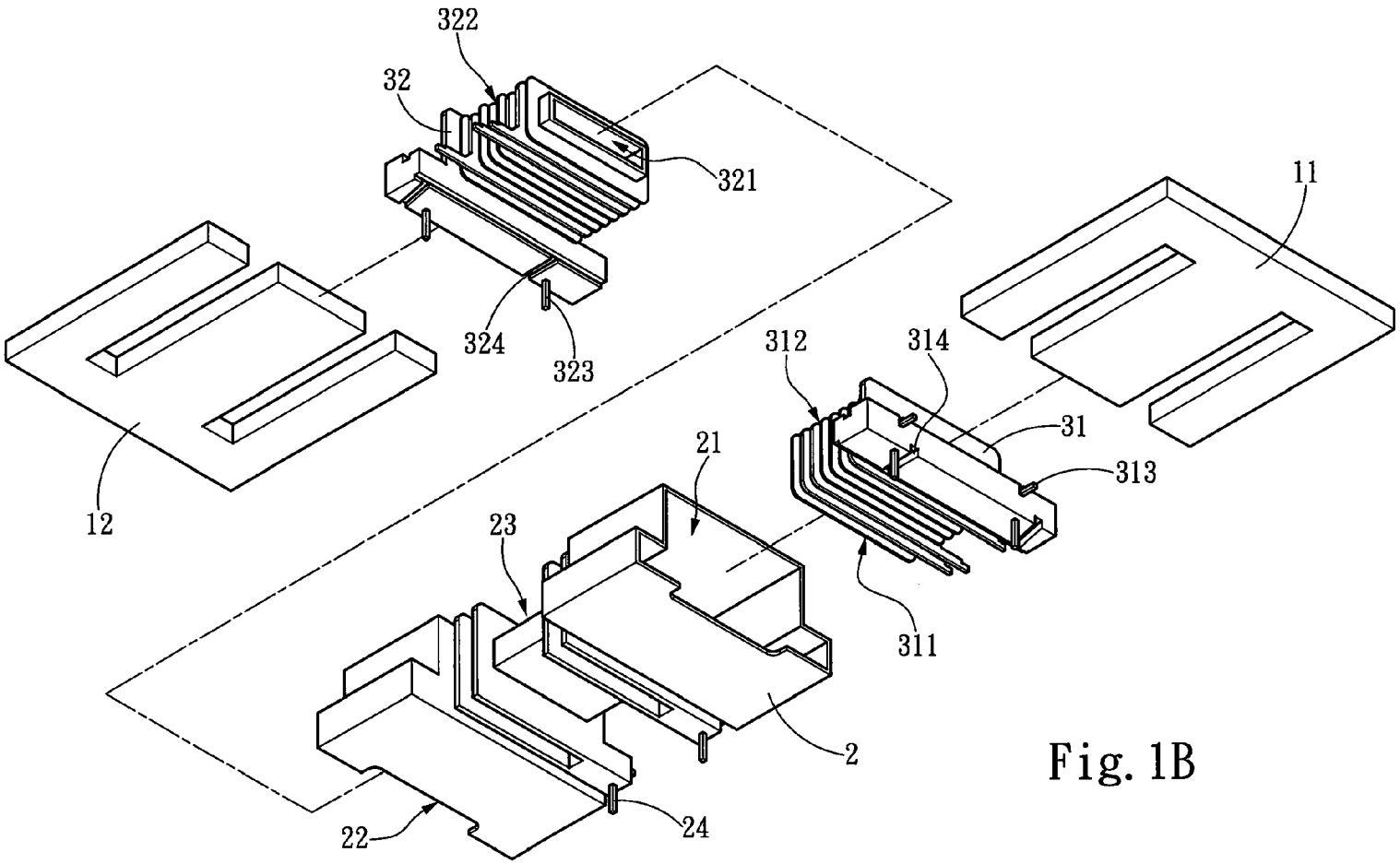
FIG. 1B is another decomposition drawing showing the transformer of the present invention.
Figure 2:
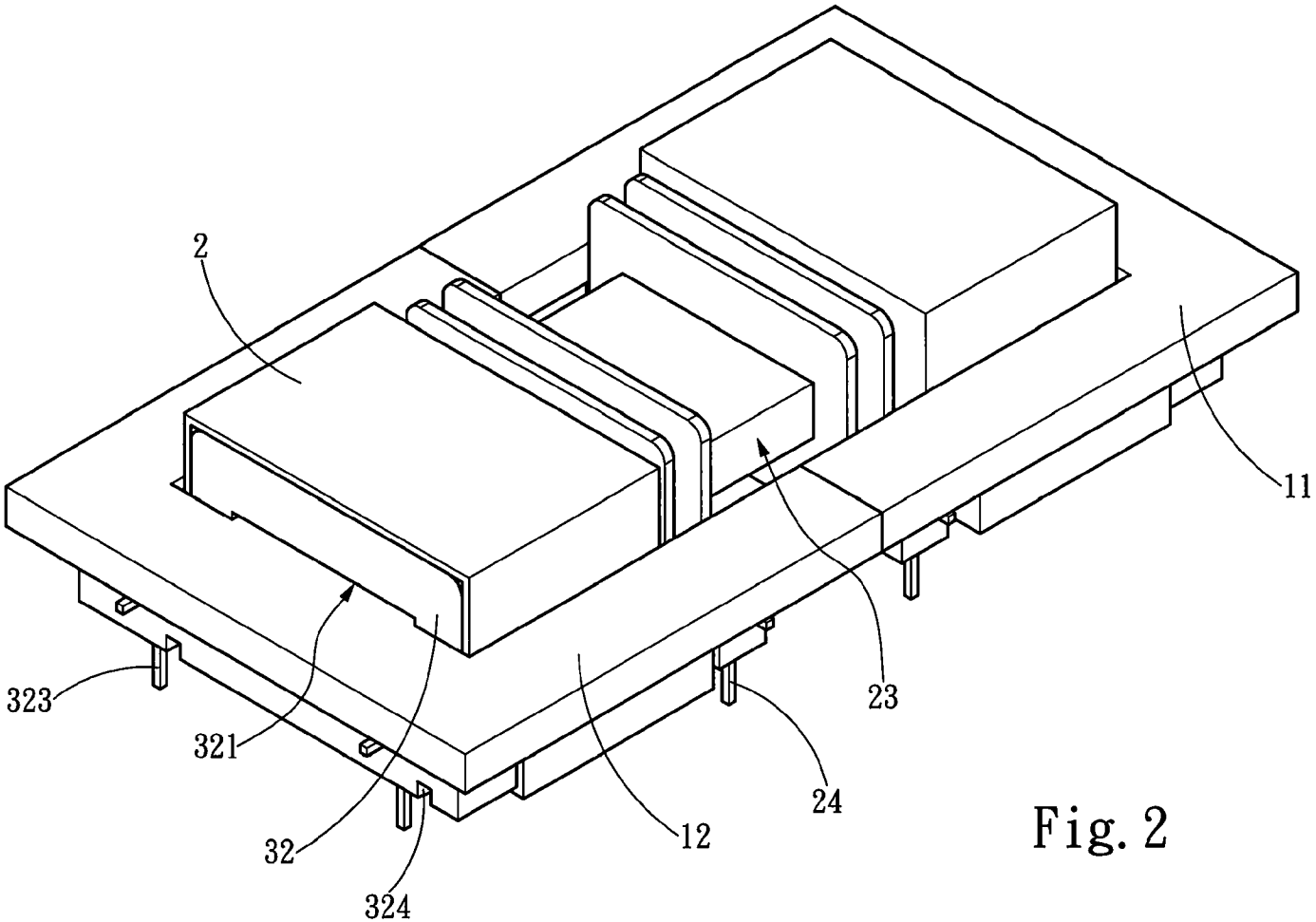
FIG. 2 is a three-dimensional drawing showing the transformer of the present invention.
Figure 4:
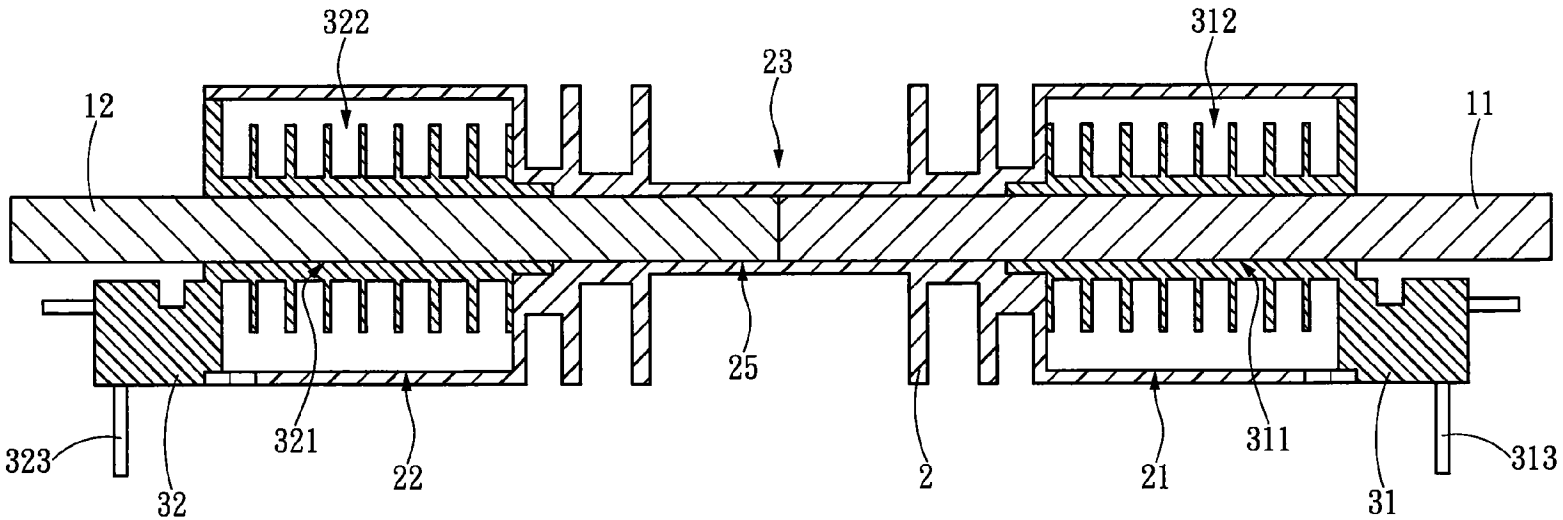
FIG. 4 is another sectional view of the transformer of the present invention.
Figure 5:
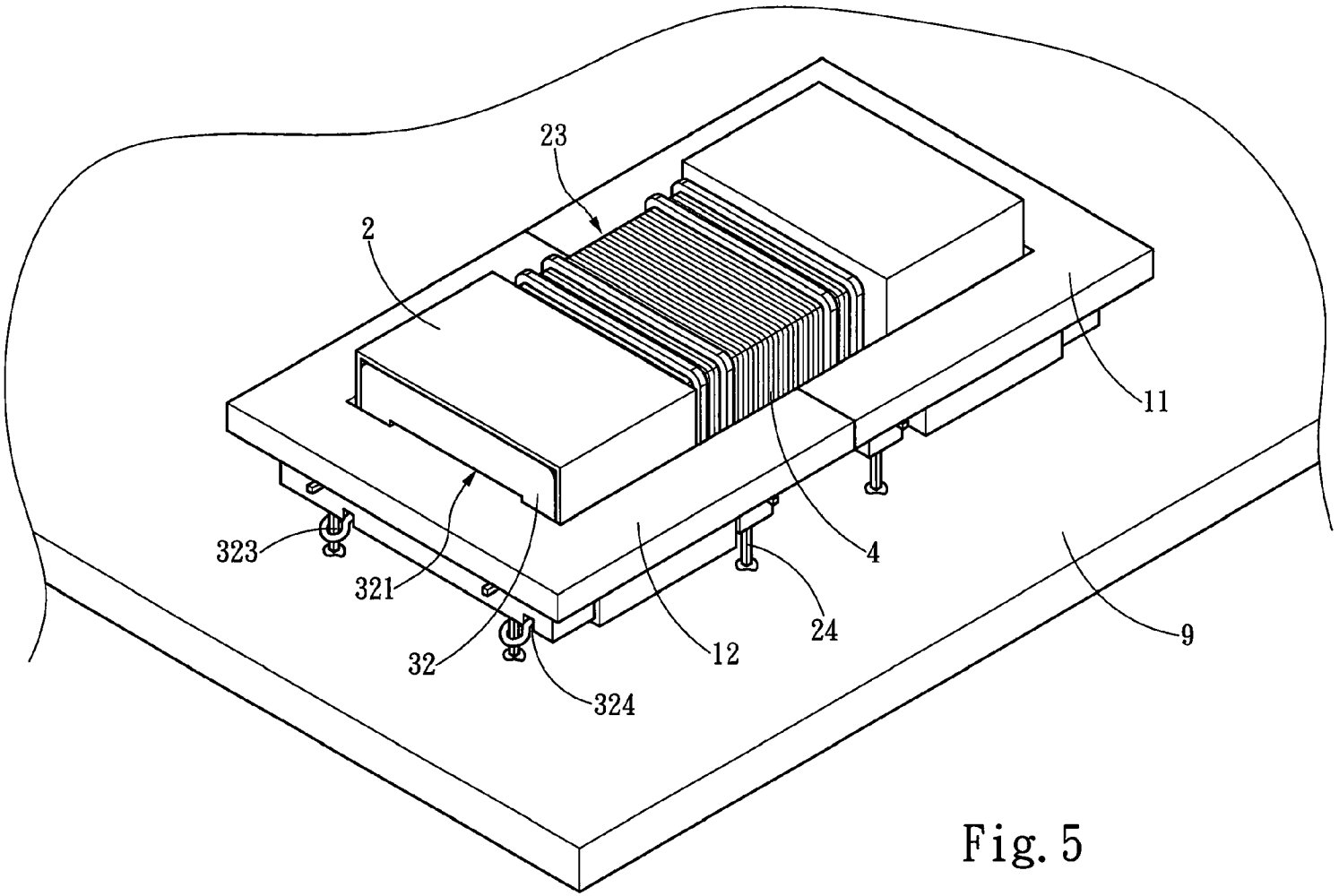
FIG. 5 is a schematic view showing the application of the transformer of the present invention.

The present invention provides a transformer structure including an iron core set, a main bobbin 2 and two sub-bobbins 31, 32 respectively mounted at two ends of the main bobbin 2. As shown in FIG. 1A and FIG. 1B, the main bobbin 2 includes a primary winding area 23 for winding a first coil 4 (as shown in FIG. 5), a main bobbin through hole 25 (as shown in FIG. 4) longitudinally penetrating through the main bobbin 2, and two assembling troughs 21, 22, which are respectively mounted at and communicated with two end openings of the main bobbin through hole 25 and have a section larger than that of the main bobbin through hole 25 for respectively accommodating two sub-bobbins 31, 32. The two sub-bobbins 31, 32 respectively have sub-bobbin through holes 311, 321 which communicate with the main bobbin through hole 25 to form a run-through space, so that the iron core set can penetrate through the main bobbin through hole 25 and the sub-bobbin through holes 311, 321. Here, the iron core set can be formed by two E-type iron cores 11, 12, but not limited, also can be C-type, L-type, I-type or a combination thereof. And, the sub-bobbins 31, 32 respectively have a secondary winding area 312, 322 for respectively winding a second coil 51, 52. Moreover, the main bobbin 2 and the sub-bobbins 31, 32 respectively have plural pins 24, 313, 323 mounted thereon, wherein the pins 313, 323 of the sub-bobbins 31, 32 are extended out of the openings of the assembling troughs 21, 22. Accordingly, the main bobbin 2, the sub-bobbins 31, 32 and the iron core set are composed of the transformer of the present invention, as shown in FIG. 2.

Figure 3:
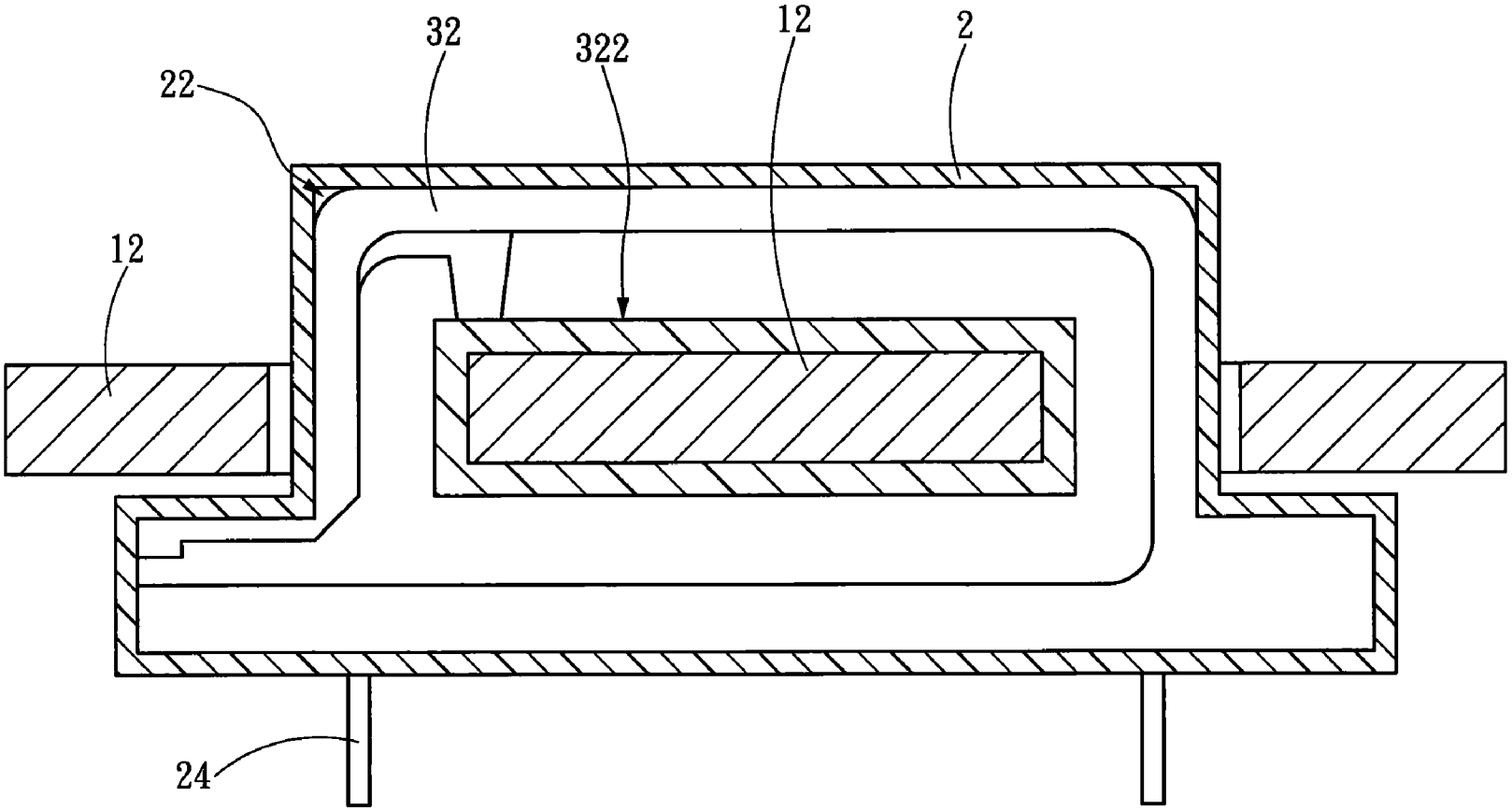
FIG. 3 is a sectional view of the transformer of the present invention.
Figure 6:
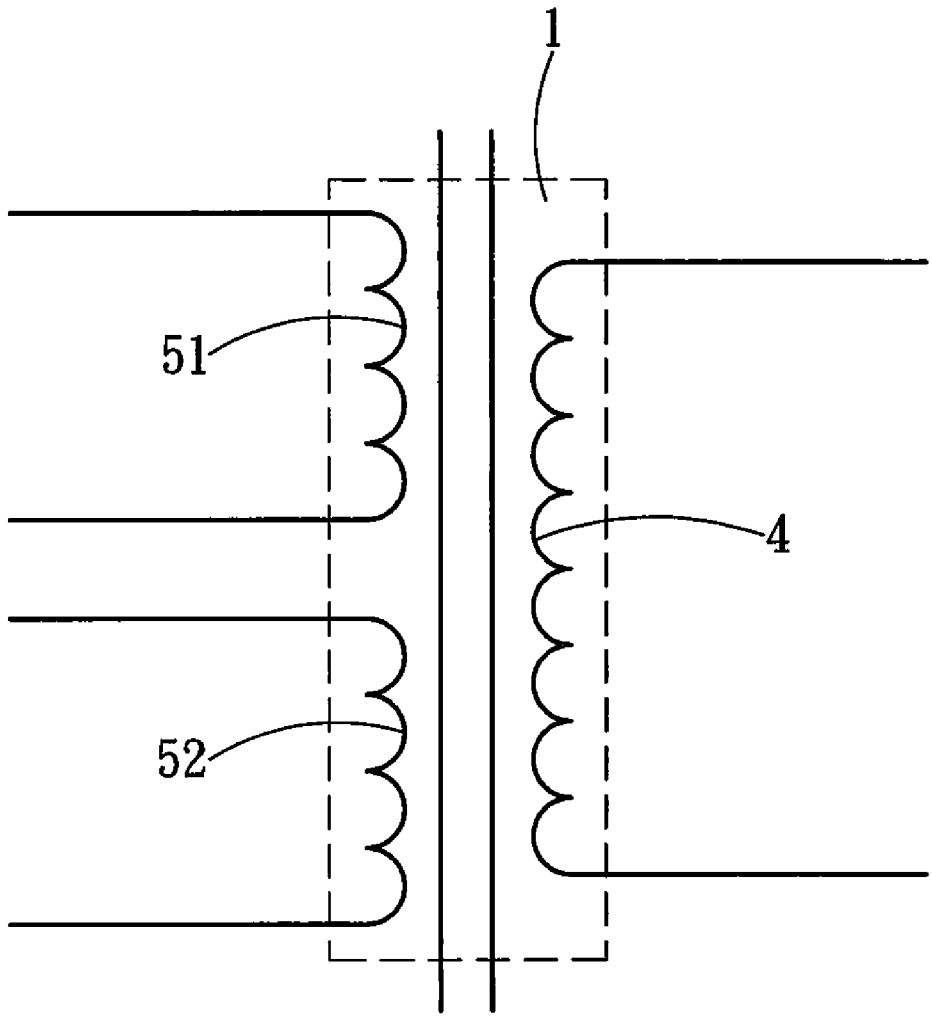
FIG. 6 is a schematic view showing the coupling of coils in the transformer of the present invention.

Please refer to FIG. 3 and FIG. 4, wherein FIG. 3 is a sectional view of the sub-bobbin through hole 321 in a vertical direction, and FIG. 4 is a sectional view of the main bobbin through hole 25 and the sub-bobbin through holes 311, 321 in a horizontal direction. As shown in FIG. 3, the assembling trough 22 of the main bobbin 2 can exactly accommodate the sub-bobbin 32 and the secondary winding area 322 of the sub-bobbin 32 is also covered by the assembling trough 22, and the iron core 12 is mounted in and penetrated through the sub-bobbin through hole 321. As shown in FIG. 4 which shows the relationship of the assembling troughs 21, 22 and the sub-bobbins 31, 32, the sub-bobbins 31, 32 seal the assembling troughs 21, 22 so as to form airtight space around the secondary winding areas 312, 322. Here, the bottoms of the sub-bobbins 31, 32 have plural holes 314, 324 for penetrating out the second coils 51, 52 to connect with the pins 313, 323 of the sub-bobbins 31, 32. FIG. 4 further shows that the iron cores 11, 12 simultaneously penetrate through the main bobbin 2 and the sub-bobbins 31, 32 and also the relationship of the primary winding area 23 and the secondary winding areas 312, 322. As shown in FIG. 4, the horizontal positions of the primary winding area 23 and the secondary winding areas 312, 322 are different, and the primary winding area 23 and the secondary winding areas 312, 322 are further separated by the assembling troughs 21, 22 and the sub-bobbins 31, 32, so as to conform the insulation strength between the primary winding area 23 and the secondary winding areas 312, 322 to the safety regulation. Please refer to FIG. 5 which is a schematic view showing a circuit board 9 with the transformer welded thereon. The primary winding area 23 of the main bobbin 2 is wound by the first coil 4, and the sub-bobbins 31, 32 are wound by the second coils 51, 52 (not shown, which are covered by the assembling troughs 21, 22). Here, the two sub-bobbins 31, 32 of the transformer can be respectively wound by two independent second coils 51, 52, so that the transformer 1 according to the input and the output of the present invention can be implemented to be an one-to-two transformer (as shown in FIG. 6) for providing more adaptability.

In the aforesaid, since the main bobbin 2 and the sub-bobbins 31, 32 provide sufficient insulation strength, the whole dimension of the transformer can be reduced under the safety regulation, and simultaneously, the output and input isolation also can be guaranteed for preventing the output power from being influenced, thereby increasing the adaptability to different circuits, especially the circuit used in driving discharging lamp, such as, back light module. Therefore, the transformer structure of the present invention provides enhanced insulation strength for conforming the safety regulations.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A transformer structure, comprising:

an iron core set;

a main bobbin, having a primary winding area for winding a first coil, a main bobbin through hole longitudinally mounted in and penetrating through the main bobbin, and two assembling troughs respectively formed at two ends of the main bobbin through hole; and two sub-bobbins, which are respectively accommodated in the two assembling troughs, respectively having a secondary winding area for winding a second coil and a sub-bobbin through hole communicated with the main bobbin through hole for penetrating the iron core set.

2. The transformer structure as claimed in claim 1, wherein the main bobbin through hole has two openings for respectively communicating with two assembling troughs, and two assembling troughs respectively have a section larger than that of the main bobbin through hole for defining a space to respectively mount and accommodate the sub-bobbins.

3. The transformer structure as claimed in claim 2, wherein each sub-bobbin has plural pins extended out of the opening of the assembling through.

4. The transformer structure as claimed in claim 1, wherein two sub-bobbins are respectively wound by two independent second coils.

5. The transformer structure as claimed in claim 1, wherein the iron core set is implemented as E-type, C-type, I-type, L-type or a combination thereof.

* * * * *